United States Patent [19]

Ho et al.

[11] Patent Number: 4,968,245

[45] Date of Patent: Nov. 6, 1990

[54] CONSTANT AND INSTANTANEOUS KEROSENE VAPORIZING BURNER

[76] Inventors: Ciang-Bin Ho, No. 4, Lane 11, Kang Shan N. St., Feng Shan City, Kaohsiung Hsien; Shyh-Bao Liaw, No. 10, Pei Ping Lane, Ta Hsin Tsun, Nei Pu Hsiang, Ping Tung Hsien, both of Taiwan

[21] Appl. No.: 396,704

[22] Filed: Aug. 22, 1989

[51] Int. Cl.[5] ..... F23D 11/44

[52] U.S. Cl. ..... 431/208; 431/243; 431/11

[58] Field of Search ..... 431/208, 207, 242, 243, 431/103, 11

[56] References Cited

U.S. PATENT DOCUMENTS 1,391,280 9/1921 Sheldon ..... 431/208 X 3,576,382 4/1971 Finnstrand ..... 431/208

4,776,787 10/1988 Hsie et al. ..... 431/208

4,827,898 5/1989 Liao et al. ..... 431/208 X

FOREIGN PATENT DOCUMENTS 752755 9/1933 France ..... 431/208

*Primary Examiner*—Carl D. Price

*Attorney, Agent, or Firm*—Varndell Legal Group

[57] ABSTRACT

This invention relates to a kerosene vaporizing burner which includes a battery which is continuously charged by AC power and used to provide electric power during an AC power failure. Ceramic heaters and flexible heaters are provided to both internally and externally heat kerosene contained within a heater, thereby providing instantaneous kerosene vaporization. A control panel is further provided for controlling flame intensity of the burner.

2 Claims, 3 Drawing Sheets

CONSTANT AND INSTANTANEOUS KEROSENE VAPORIZING BURNER

BACKGROUND AND SUMMARY OF THE INVENTION

The present invention relates to a kerosene vaporizing burner and, more particular, to a kerosene vaporizing burner which can instantaneously vaporize kerosene for burning and can be used during an AC power failure.

A regular gas furnace can produce a large amount of carbon monoxide due to incomplete combustion. People can be poisoned to death when exposed to air having a concentration of carbon monoxide of less than 1% of carbon monoxide for one minute. Further, due to high volatility of gas, air will quickly become flammable when it contains a certain ratio of gas. If air contains 2.2–9.5% of gas, it will explode when sparked. This explains why gas explosions are regularly heard. In comparison with gas, kerosene is safer in use due to its low volatility. Kerosene is not easy to burn even if it is directly touched by fire. When kerosene is burned, it produces a small amount of carbon monoxide. In addition to the advantage of being safer than gas, kerosene is also less expensive. Therefore, kerosene burners or furnaces or the like are still commonly used.

Regular kerosene burners which are commonly used may include two types, one is the conventional type as illustrated in FIG. 1, and the other is separation type as illustrated in FIG. 2. However, neither of these kerosene burners is practical in use due to the drawbacks described below.

1. The conventional type kerosene burner as shown in FIG. 1 has the following drawbacks:

(A) The vaporizer hood is welded to the vaporizer pan around the jet pipe. Since the vaporizer pan and vaporizer hood are made of different materials, and since there is a large contact area therebetween, it is difficult to maintain a weld of sufficient quality between the vaporizer pan and hood. Due to the high temperature difference of kerosene before and after ignition and the large volume expansion of vaporized kerosene (i.e., 270 times over liquid form), the resulting severe expansive force inside the vaporizer hood can cause the vaporizer pan to deform or the weld to crack, thereby causing vaporized kerosene to leak. This can result in poor or incomplete combustion of kerosene which consumes excessive kerosene and can permit kerosene odor to escape into the environment; and (B) During the burning of kerosene, heat is inefficiently conducted from the vaporizer pan to the vaporizer hood for vaporization of kerosene, thus the kerosene cannot be fully vaporized and high efficiency of combustion cannot be achieved.

The separation type kerosene burner as shown in FIG. 2 has the following drawbacks:

(A) When vaporized kerosene is ejected through the jet holes for burning, the flame directly burns the vaporizer pan. Because heat is conducted from the vaporizer pan to the oil duct, the efficiency of heat conduction is deteriorated so that incomplete vaporize kerosene results. Although a hole is provided on the pan for return flame, only a small amount of flame enters the hole to assist in vaporizing the kerosene in the oil duct; and (B) Its structure is more complicated, making it difficult to assemble and expensive to manufacture.

In addition to the above drawbacks, both the conventional type and the separation type kerosene burners have the following common disadvantages:

(A) A coil heater is provided below the vaporizer hood or oil duct for heat vaporization of kerosene before burning. The coil heater is normally comprised of a tungsten coil for electric heating, which produces heat up to 900° F. This indirect heating method is about 65% less efficient than the direct heating method. Therefore, it takes a longer time (i.e., 5–6 minutes) to vaporize kerosene;

(B) During burning, the coil heater remains turned on in order to provide supplementary heat for vaporizing kerosene, which consumes excessive electric power;

(C) The intensity of the flame cannot be properly adjusted. When the control knob is turned on, the intensity of the flame cannot be properly controlled according to a desired requirement; and (D) During a power failure, the kerosene vaporization heating and ignition processes are not functional, and the burner becomes useless.

It is therefore the main object of the present invention to provide a constant and instantaneous kerosene vaporizing burner which can be used during an AC power failure.

Another object of the present invention is to provide a constant and instantaneous kerosene vaporizing burner which can effectively vaporize kerosene for burning.

A further object of the present invention is to provide a constant and instantaneous kerosene vaporizing burner which includes a flame control panel for efficiently controlling the intensity of the flame.

The above and other objects, features and advantages of the present invention will become apparent from the following detailed description of the preferred embodiment considered in connection with the annexed drawings.

DETAILED DESCRIPTION OF THE PREFERRED EMBODIMENTS

Figure 1:
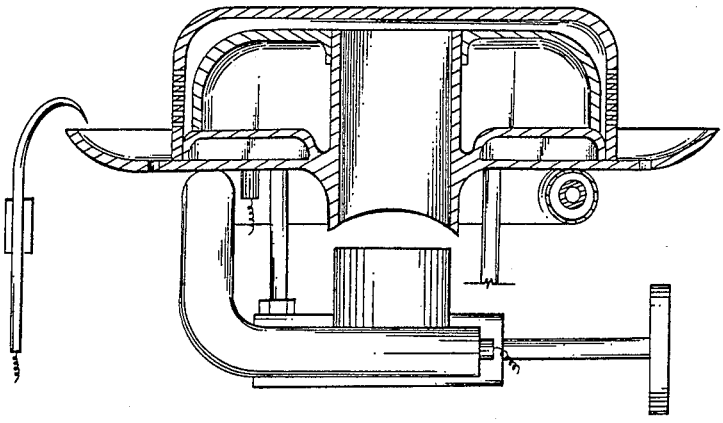
FIG 1 PRIOR ART
FIG. 1 is a sectional assembly view of a kerosene burner of a conventional type.
Figure 2:
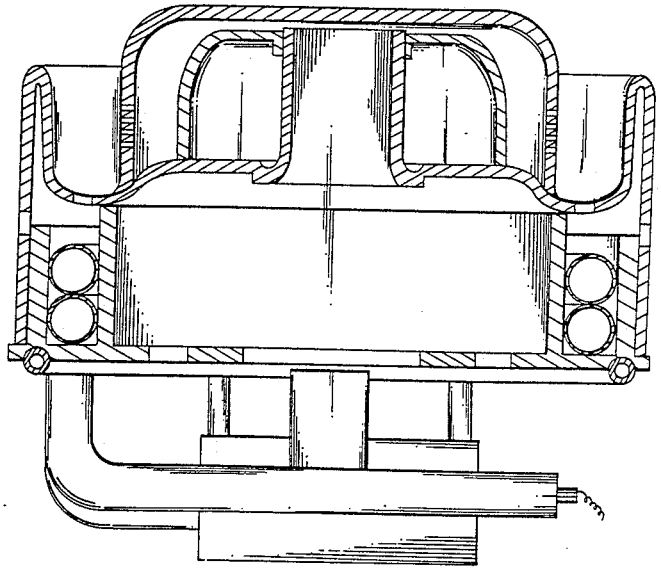
FIG 2 PRIOR ART
FIG. 2 is a sectional assembly view of a separating kerosene burner according to the prior art.
Figure 3:
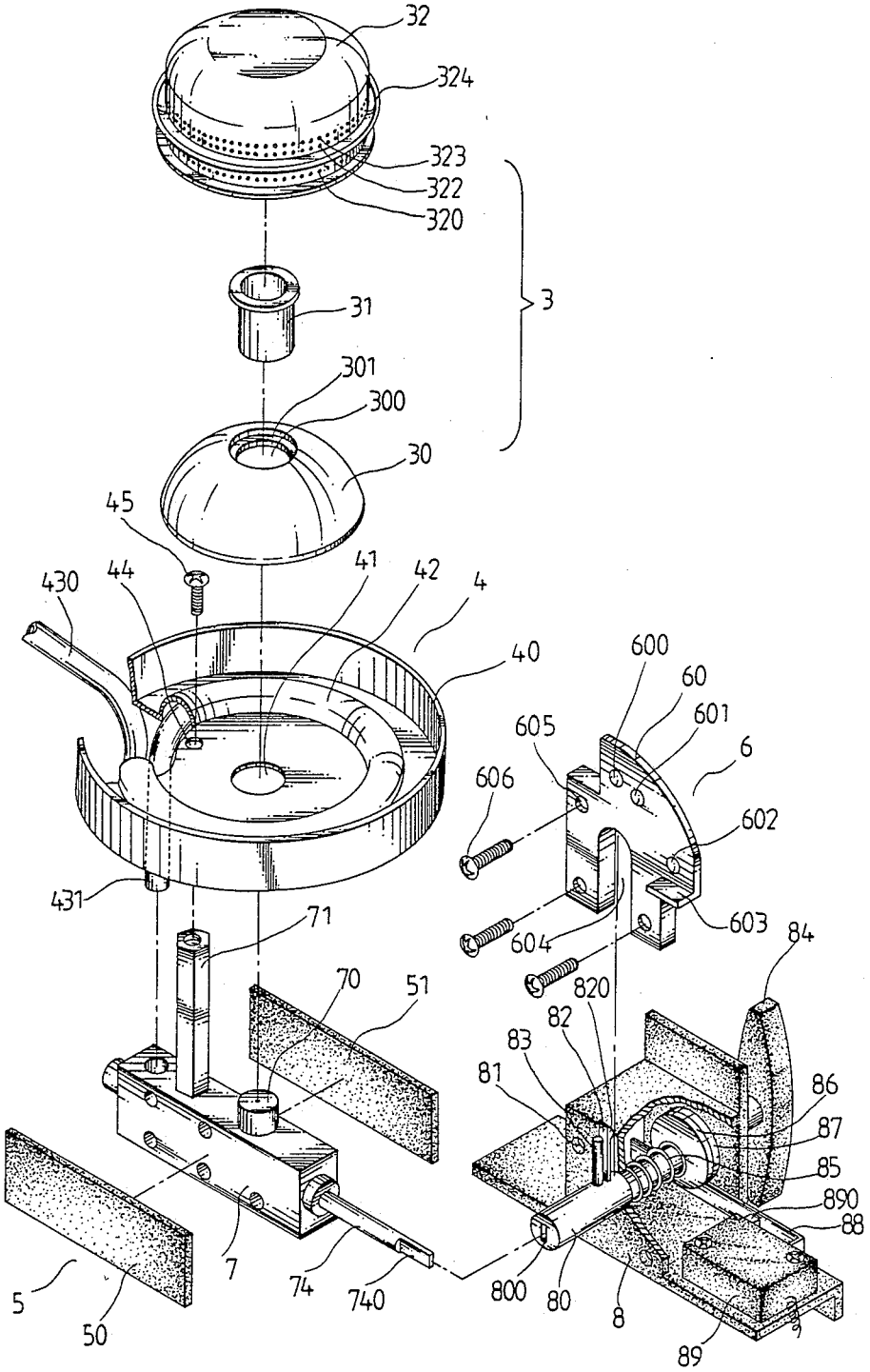
FIG. 3 is a perspective exploded view of a kerosene vaporizing burner embodying the present invention.
Figure 4:
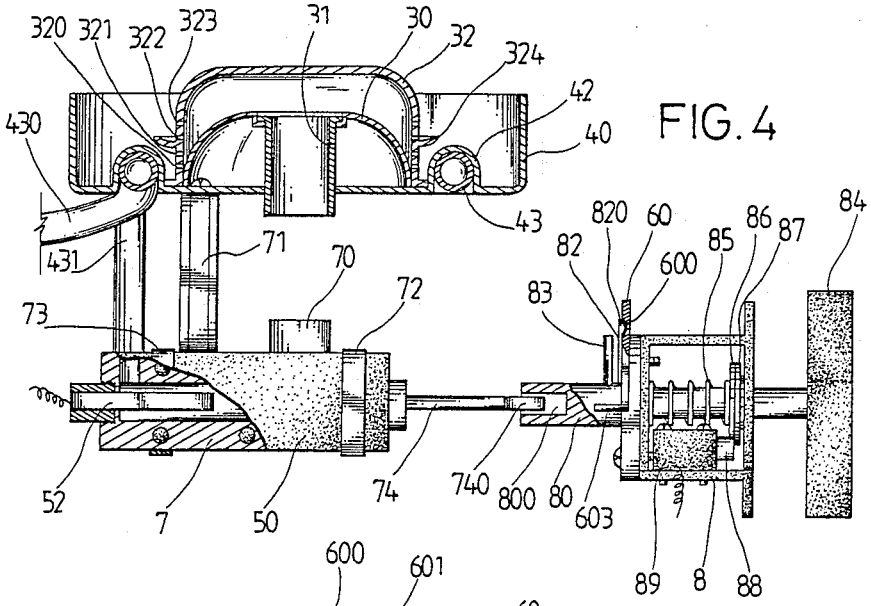
FIG. 4 is a sectional assembly view of the present invention.

FIGS. 3 and 4 show a kerosene vaporizing burner embodying the present invention, including a burner 3, a vaporizer 4, a heater assembly 5, a flame controller 6, an oil sprayer 7 and a seat 8.

The burner 3, as illustrated, is mounted on top of the vaporizer 4 and is comprised of a reflector 30 and a cover collector 32. The reflector has a fixing hole 300 at its top which includes a positioning slot 301 for receiving a socket 31. The socket 31 has a passage through which vaporized oil is ejected arranged at its center. The cover collector 32 covers the reflector 30 and comprises four channels of vapor holes 320, 321, 322 and 323 divided by a ring-portion 324. The channels of vapor holes 320 and 321 are disposed about the periphery of collector 32 at the lower portion thereof, and the channels of vapor holes 322 and 323 are disposed about the periphery of collector 32 at the upper portion thereof.

The vaporizer 4 comprises a housing 40 having a through-hole 41 at its center for receiving the socket 31 so as to communicate with the nozzle 70 of an oil sprayer 7. A raised concealed channel 42 is circularly arranged around the through-hole 41 and provides an area on which the cover collector 32 is mounted. An oil pipe 43 is provided within the raised concealed channel 42. The oil pipe 43 is properly sized to fit within the raised concealed channel 42 for better heat conduction and comprises a front extension connected to kerosene reservoir as oil filling pipe 430 and a rear extension welded to the oil sprayer 7 as a kerosene oil duct 431, which permits vaporized kerosene to flow into the oil sprayer 7. A round hole 44 is provided at a suitable position between the through-hole 41 and the raised concealed channel 42 through which the vaporizer 4 is fastened to the stand 71 of the oil sprayer 7 by a screw.

The heater assembly 5 includes two ceramic heaters 50 and 51 and a flexible heater 52. The ceramic heaters 50 and 51 are bilaterally attached to the oil sprayer 7 and fixedly connected thereto by means of elastic steel fixtures 72 and 73, and the flexible heater 52 is inserted from the rear into the inner chamber of the oil sprayer 7. When the power is connected to the heater assembly 5, the ceramic heaters 50 and 51 and the flexible heater 52 will produce heat up to 1300° F.–1700° F. within 3 seconds. Through concomitantly internal and external heating, the kerosene oil is instantaneously vaporized within 20 seconds before burning.

Figure 5:
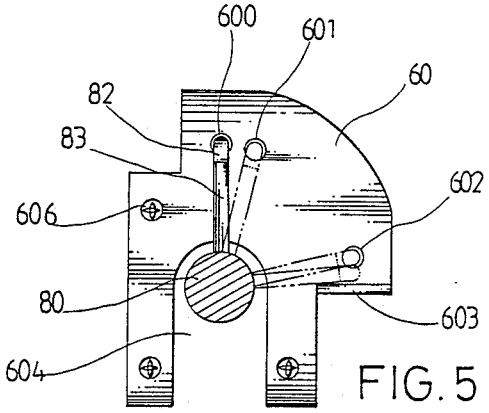
FIG. 5 is a schematic view of the flame control panel according to the present invention.

The flame controller 6 generally includes a control panel 60 having circular recesses 600, 601 and 602, a stop plate 603 disposed at the bottom of the circular recess 602, a notch 604 below the circular recess 600 for mounting the control panel 60 on the revolving axle 80 of its seat 8, and a plurality of holes 605 through which screws 606 screw into the corresponding bolt holes 81 for fastening the control panel 60 to the side wall of the seat 8. The seat 8 has a revolving axle 80, an elastic steel plate 82 disposed above the revolving axle 80 which includes a circular block 820 at its top. The circular block 820 can be set in the circular recess 600 of the control panel 60. The seat 8 also includes a steel rod 83 vertically mounted on the revolving axle 80 adjacent to the steel plate 82. The revolving axle 80 has a rectangular hole 800 on its front end which is adapted to receive the elongated rectangular front end 740 of the control lever 74 which extends from the oil sprayer 7. The revolving axle 80 revolves when the control knob 84 is turned causing the control lever 74 to rotate simultaneously therewith for controlling the flame of the oil burner. Before burning, the circular block 820 of the elastic steel plate 82 is retained in the circular recess 600. In this position the oil sprayer 7 is turned off. This permits the oil burner to be turned off by rotating the control lever 74. Spring 85 is mounted on the revolving axle 80 and received inside the seat 8, and two circular plates 86 and 87 are also mounted on the revolving axle 80. The spring 85 is arranged to force plates 86 and 87 in a rightward position, as shown in FIG. 4, which holds the circular block 820 in the circular recesses. When the control knob is pressed inward (leftward as shown in FIG. 4), the revolving axle 80 moves forward (leftward as shown in FIG. 4), resulting in the circular block 820 of the steel plate 82 being removed from the circular recess 600. Simultaneously, the thinner steel plate 88, which is held in place by the circular plates 86 and 87 at the bottom thereof, pushes the switch rod 890 of the micro-switch 89 thereby switching the micro-switch on for ignition. At the same time, the control knob 84 is slightly turned for a certain range, and vaporized kerosene is ejected through the oil sprayer 7 for ignition and subsequent burning. As soon as the pressure force is released from control knob 84, the control knob 84 is immediately pushed by the spring 85 and returned to its original position, and the thinner steel plate 88 is moved away from the switch rod 890 to stop ignition. Therefore, the elastic steel plate 82 contacts the control panel 60 again, but the circular block 820 need not be set in the circular recess 601. Accordingly, the control knob 84 can be revolved again, so that the circular block 820 will be immediately set into the circular recess 601 (see FIG. 5). At this position, the flame is smaller and the resulting heat is less intensive. When a higher intensity of heat is required, the control knob 84 can be pushed inward and turned, displacing the circular block 820 of the elastic steel plate 82 from the circular recess 601 and permitting the circular block 820 of the elastic steel plate 82 to be set into the circular recess 602. The control knob 84 can be rotated a predetermined amount, and its rotation will be stopped when the steel rod 83 abuts the stop plate 603. At this position, the intensity of heat or size of the flame reaches the maximum range. Through the arrangement of the stop plate 603, the intensity of heat or size of the flame can be controlled within a safety range. When the control knob 84 is turned backward so that the circular block 820 is set in the circular recess 600, the flame in the burner is extinguished immediately.

Referring to FIG. 4, after vaporized kerosene oil gas is ejected through vapor holes 320, 321, 322 and 323 and it will be burned at 1200° F. When burning is adjusted to the less intensive range, the vaporized kerosene oil passing through vapor holes 320 and 321 is burned so that its flame directly heats the raised concealed channel 42 for instantaneously vaporizing kerosene oil in the oil pipe 43 for further burning. When the flame is increased to the range of high intensity heat, in addition to directly heating the raised concealed channel 42, the flame also passes through a circular gap between the ring-portion 324 and the raised concealed channel 42 in a manner which does not interfere with the burning of the vaporized kerosene.

Figure 6:
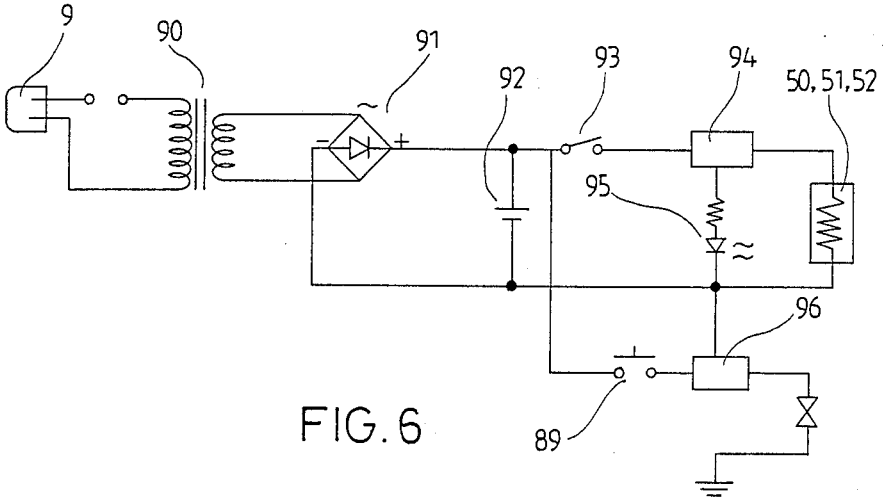
FIG. 6 is a circuit diagram of the control circuit according to the present invention.

FIG. 6 illustrates a control circuit of the present invention where an AC power supply 9 is connected to a battery 92 through a transformer 90 and a bridge rectifier 91. Under normal conditions, AC power supply 9 provides a floating charge to the battery 92. During a power failure, the battery 92 provides the kerosene vaporizing burner with necessary power for ignition and vaporization. The control circuit includes a main switch 93. When the main switch 93 is turned ON, the ceramic heaters 50 and 51 and the flexible heater 52 immediately produce heat at 1300° F.–1700° F. for heating the kerosene oil in the oil sprayer 7. Approximately 20 seconds after heating, the kerosene oil will be heated to a vaporized burning point of 297° F. Through the operation of the temperature controller 94, the indicator lamp 95 will be turned on immediately after the vaporized burning temperature is detected and, simultaneously, power supply will be cut off from the ceramic heaters 50 and 51 and the flexible heater 52 in order to minimize power consumption. At this time, the control knob 84 may be pressed down to turn on the microswitch 89, triggering the igniter 96 to ignite the vaporized kerosene oil.

As described above, the present invention provides a kerosene vaporizing burner having numerous features and advantages including the following:

(A) A battery 92 is provided for use during an AC power failure;

(B) Ceramic heaters 50 and 51 and flexible heater 52 are used to instantaneously produce a large amount of heat for internally and externally heating the kerosene for instantaneous vaporization thereof;

(C) As soon as the kerosene is vaporized, the power supply is cut off automatically from the ceramic heaters 50 and 51 and the flexible heater 51 to minimize power consumption;

(D) When vaporized kerosene is burned, during less intensive heating, the flame through the steam holes 320 and 321 directly heats the raised concealed channel 42 to assist in vaporizing the kerosene in the oil pipe 43; and during high intensity heating, in addition to directly heating the raised concealed channel 42, the flame passes through the gap between the ring-portion 324 and the raised concealed channel 42 in a manner which does not interfere with the burning of vaporized kerosene;

(E) The flame control panel 60 is provided, which permits easy adjustment of the intensity of the flame, thus preventing excessively intensive heating.

We claim:

1. A kerosene vaporizing burner comprising:

an oil sprayer including a nozzle, a stand, and a control lever;

a heater assembly including two ceramic heaters bilaterally attached to said oil sprayer and fixedly connected thereto by elastic steel fixtures, and a flexible heater inserted into an inner chamber of said oil sprayer;

a flame controller including a revolving axle having one end connected to said control lever; an elastic plate attached to said revolving axle and having a circular block thereon; a control panel having an elastic plate with three circular recesses radially arranged thereon, a stop plate and a notch arrange below said three circular recesses for mounting said control panel above said revolving axle; said three circular recesses selectively receiving said circular block by rotation of said control lever for eliminating a flame of said burner, providing a lower flame of said burner and providing a higher flame of said burner; said stop plate limiting rotation of said revolving axle to a maximum flame amount;

a vaporizer including a housing having a through-hole at its center, a raised concealed channel circularly disposed around said through-hole, an oil pipe set contained within said raised concealed channel, said oil pipe including a front extension connected to a kerosene reservoir for supplying kerosene oil thereto and a rear extension welded to said oil sprayer for supplying vaporized kerosene to said oil sprayer, and a round hole arranged between said through-hole and said raised concealed channel for fastening said vaporizer to said stand;

a burner mounted on top of said vaporizer, including a reflector and a cover collector, said reflector having a hole in its top defining a positioning slot for receiving a socket, said socket fitting within said through-hole of said vaporizer and having a passage communicating with said nozzle for ejecting vaporized kerosene, said cover collector covering said reflector and being mounted about said raised concealed channel of said vaporizer, said cover including four channels of vapor holes with two upper channels of said four channels arranged above a ring-portion and two lower channels of said four channels arranged below said ring-portion; and a control circuit including a battery constantly charged by AC power for providing electric power during an AC power failure.

2. The kerosene vaporizing burner as set forth in claim 1, wherein said two lower channels of holes are arranged so that a flame exiting therefrom directly heats said oil pipe received in said circularly raised concealed channel, and said ring-portion and said circularly raised concealed channel are arranged with a circular gap therebetween so that said larger flame can pass therethrough without interfering with burning of vaporized kerosene.

* * * * *